US007088252B2

(12) United States Patent
Weekes

(10) Patent No.: US 7,088,252 B2
(45) Date of Patent: Aug. 8, 2006

(54) SYSTEMS AND APPARATUS FOR PERSONAL SECURITY

(76) Inventor: David Weekes, 4th Avenue #33 Mangrove Grove, Opposite Sugar Cane Club, Maynards, St. Peter 818 (BB)

( * ) Notice: Subject to any disclaimer, the term of this patent is extended or adjusted under 35 U.S.C. 154(b) by 0 days.

(21) Appl. No.: 11/119,799

(22) Filed: May 3, 2005

(65) Prior Publication Data

US 2005/0275542 A1 Dec. 15, 2005

Related U.S. Application Data

(63) Continuation-in-part of application No. 10/986,864, filed on Nov. 15, 2004.

(60) Provisional application No. 60/578,283, filed on Jun. 10, 2004, provisional application No. 60/590,436, filed on Jul. 23, 2004.

(51) Int. Cl.
*G08B 23/00* (2006.01)

(52) U.S. Cl. ..... 340/573.1; 340/572.1; 340/652

(58) Field of Classification Search ..... 340/573.1
See application file for complete search history.

(56) References Cited

U.S. PATENT DOCUMENTS

| | | | | |
|---|---|---|---|---|
| 4,885,570 | A | 12/1989 | Chien | |
| 5,337,041 | A * | 8/1994 | Friedman | 340/573.4 |
| 5,646,592 | A | 7/1997 | Tuttle | |
| 5,656,996 | A | 8/1997 | Houser | |
| 6,160,478 | A * | 12/2000 | Jacobsen et al. | 340/539.12 |
| 6,198,394 | B1 * | 3/2001 | Jacobsen et al. | 340/573.1 |
| 6,317,050 | B1 * | 11/2001 | Burks | 340/573.6 |
| 6,400,268 | B1 | 6/2002 | Lindskog | |
| 6,450,816 | B1 * | 9/2002 | Gerber | 434/11 |
| 6,611,783 | B1 * | 8/2003 | Kelly et al. | 702/150 |
| 6,898,299 | B1 | 5/2005 | Brooks | |
| 6,917,294 | B1 | 7/2005 | Larsen | |
| 2002/0013538 | A1 * | 1/2002 | Teller | 600/549 |
| 2003/0011466 | A1 | 1/2003 | Samuel et al. | |
| 2004/0178913 | A1 * | 9/2004 | Penuela et al. | 340/573.1 |

FOREIGN PATENT DOCUMENTS

| | | |
|---|---|---|
| FR | 2434436 | 3/1980 |
| WO | WO 2004/037660 | 5/2004 |

OTHER PUBLICATIONS

PCT/IB2005/004010 Search Report dated May 12, 2006 (4 pages).

* cited by examiner

*Primary Examiner*—Daniel Wu
*Assistant Examiner*—George Bugg
(74) *Attorney, Agent, or Firm*—Finnegan, Henderson, Farabow, Garrett & Dunner, L.L.P.

(57) ABSTRACT

A personal security device is provided. The device includes a wireless transmitter operable to transmit information pertaining to a user to a monitoring network. The device also includes a sensor for sensing removal of the transmitter from the user's person. The device further includes a manager initiating transmission of a signal to the monitoring network when the sensor senses that the transmitter has been removed from the user's person.

26 Claims, 4 Drawing Sheets

SYSTEMS AND APPARATUS FOR PERSONAL SECURITY

RELATED APPLICATIONS

This application is a continuation-in-part of U.S. application Ser. No. 10/986,864, filed Nov. 15, 2004. This application also claims the benefit of priority under 35 U.S.C. 119 to U.S. Provisional Application No. 60/578,283, filed Jun. 10, 2004, and to U.S. Provisional Application No. 60/590,436, filed Jul. 23, 2004. All of the above-mentioned applications are expressly incorporated herein by reference in their entirety.

TECHNICAL FIELD

The present invention relates generally to personal security, and, more particularly, to systems and apparatus for monitoring the personal safety of users.

BACKGROUND

It is frequently necessary or desirable for people to live or work in areas where their personal safety cannot be assured. For example, it is often desirable for aid workers, such as medical personnel, to operate in war zones or other places with no government authority. Further, it is often necessary for ordinary citizens to live and work in areas where their government authorities are not able to provide adequate security. However, people in such areas are often subject to threats to their personal safety, such as kidnappings by, e.g., ideologically or monetarily motivated groups, such as terrorists or insurgents.

In the past, people in such areas have been equipped with devices which monitor their location, and/or provide them with the ability to broadcast a "panic" signal once they recognize a threat to their personal security. However, these devices do not provide complete security because, first, such threats may materialize before people recognize that they are occurring, and, second, the devices may easily removed from the control of the person they are designed to protect, and thus give a false indication of the location or well-being of the person.

In addition, electronic home-detention systems are known in which a detainee is fitted with a transmitter collar around an appendage (e.g., an ankle), which transmits a signal. A monitoring station placed in the detention area senses whether the detainee has left the detention area by sensing the absence of the signal from the transmitter. If the detainee is determined to have left the detention area, the monitoring station may alert law enforcement authorities. However, such systems are designed to prevent the detainee from leaving the detention area, rather than ensuring their personal safety. In addition, such devices may sometimes be taken off of the detainee's appendage without alerting authorities.

Consequently, existing systems fail to meet the security requirements of people who live and/or work in insecure areas. Accordingly, there is a need for systems and apparatus to deter and prevent threats to such persons' personal safety.

SUMMARY

The present invention addresses these and other needs by providing systems and apparatus to increase the personal safety of users.

Consistent with the present invention, a personal security device is provided. The device includes a wireless transmitter operable to transmit information pertaining to a user to a monitoring network. The device also includes a sensor for sensing removal of the transmitter from the user's person. The device further includes a manager initiating transmission of a signal to the monitoring network when the sensor senses that the transmitter has been removed from the user's person.

Consistent with the present invention, a personal security system is provided. The system comprises a monitoring network and at least one personal security device. The personal security device includes a wireless transmitter operable to transmit information pertaining to a user to a monitoring network. The device also includes a sensor for sensing removal of the transmitter from the user's person. The device further includes a manager initiating transmission of a signal to the monitoring network when the sensor senses that the transmitter has been removed from the user's person.

It is to be understood that both the foregoing general description and the following detailed description are exemplary and explanatory only and are not restrictive of the invention, as claimed. Further features and/or variations may be provided in addition to those set forth herein. For example, the present invention may be directed to various combinations and subcombinations of the disclosed features and/or combinations and subcombinations of several further features disclosed below in the detailed description.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 1:
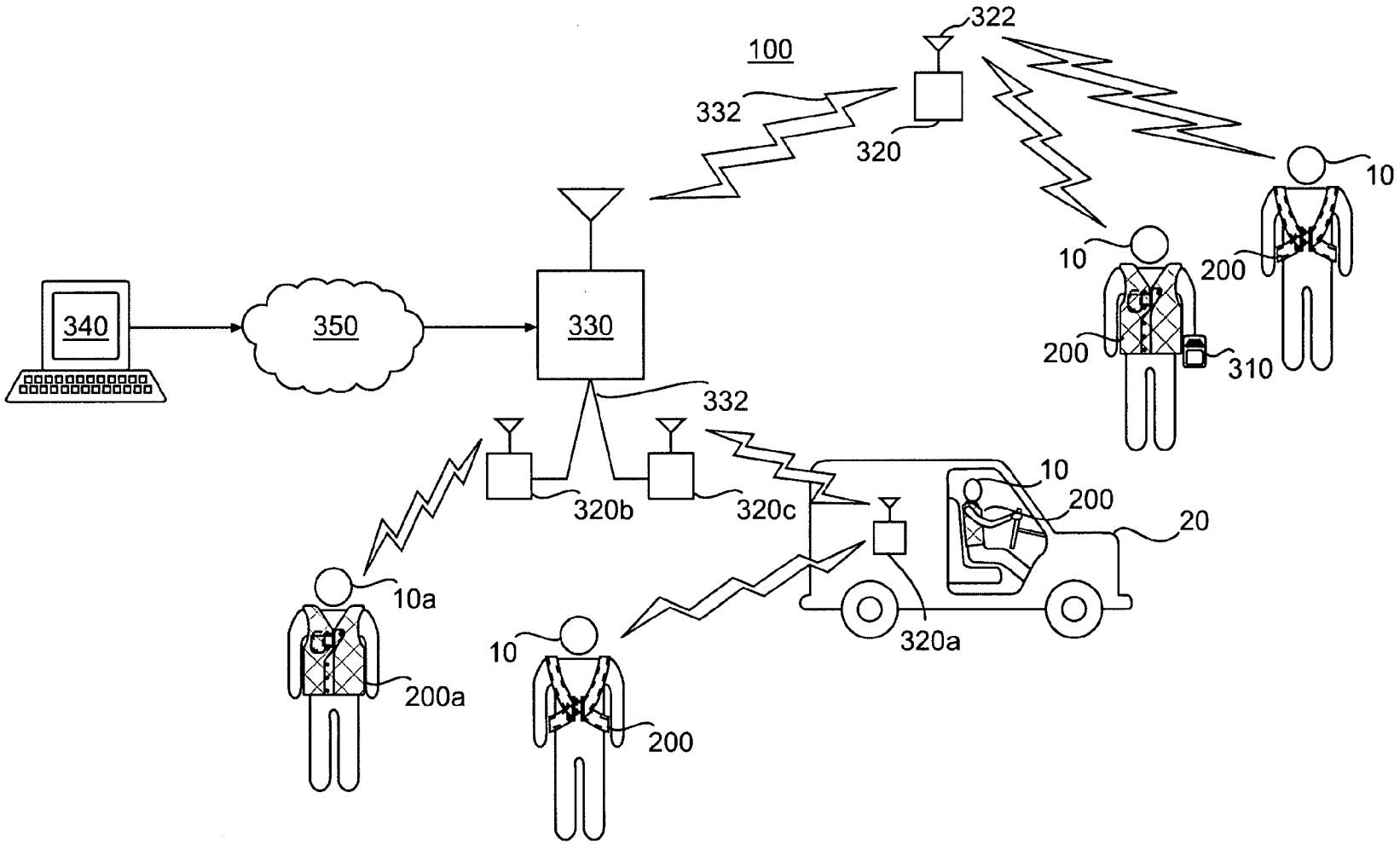
FIG. 1 shows and exemplary security system, consistent with the present invention.

FIG. 1 schematically illustrates an exemplary security system 100 for monitoring the personal safety of one or more users 10. As shown in FIG. 1, security system 100 may include one or more personal security devices 200 to be worn or carried by each user 10 monitored by security system 100, and a network 300 for monitoring the personal safety of users 10 by communicating with personal security devices 200.

As shown in FIG. 1, monitoring network 300 may include one or more authenticators 310, monitors 320, network hubs 330, and access terminals 340. The function of each of these components is described below.

Figure 2:
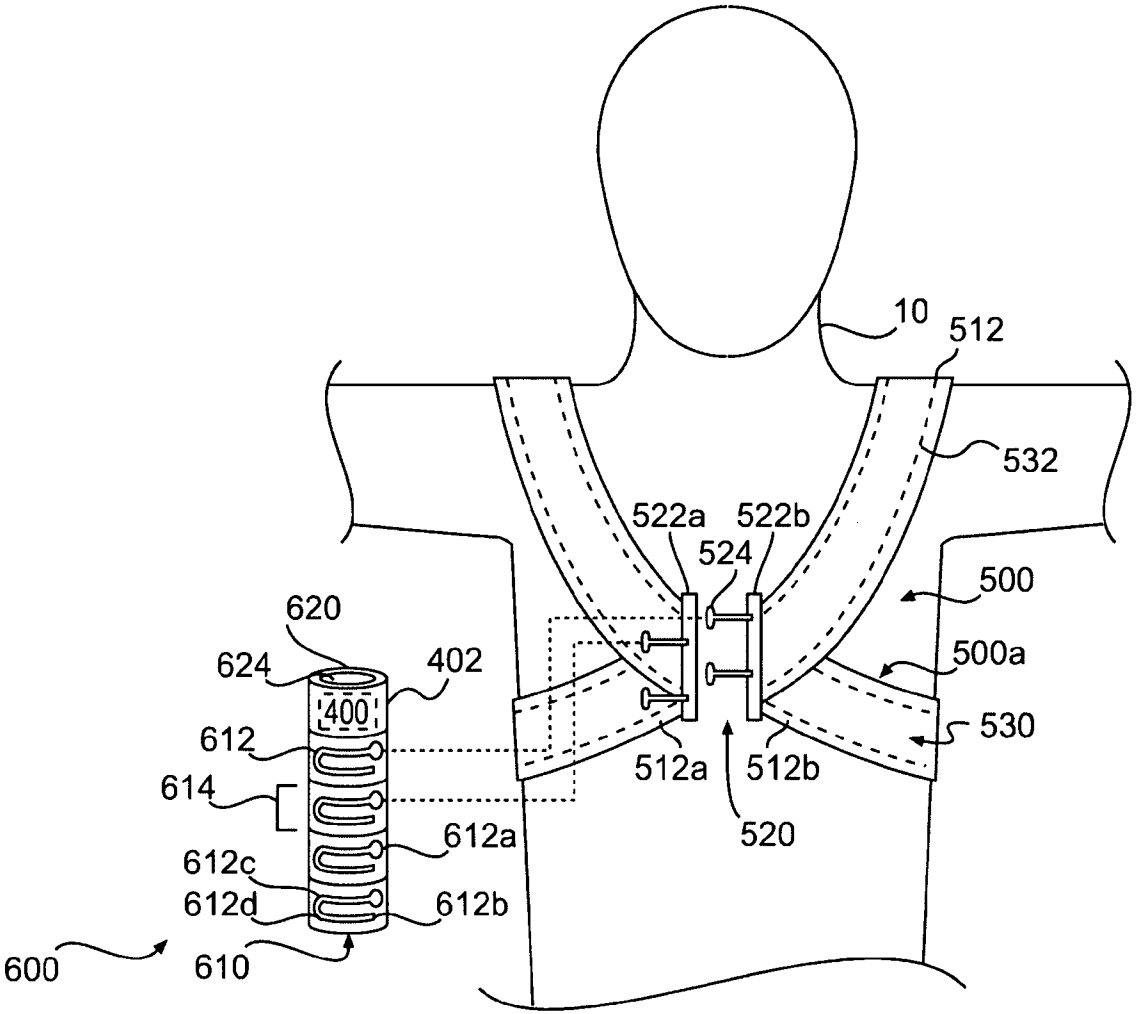
FIG. 2 shows a first exemplary embodiment of a personal security device consistent with the present invention.
Figure 3:
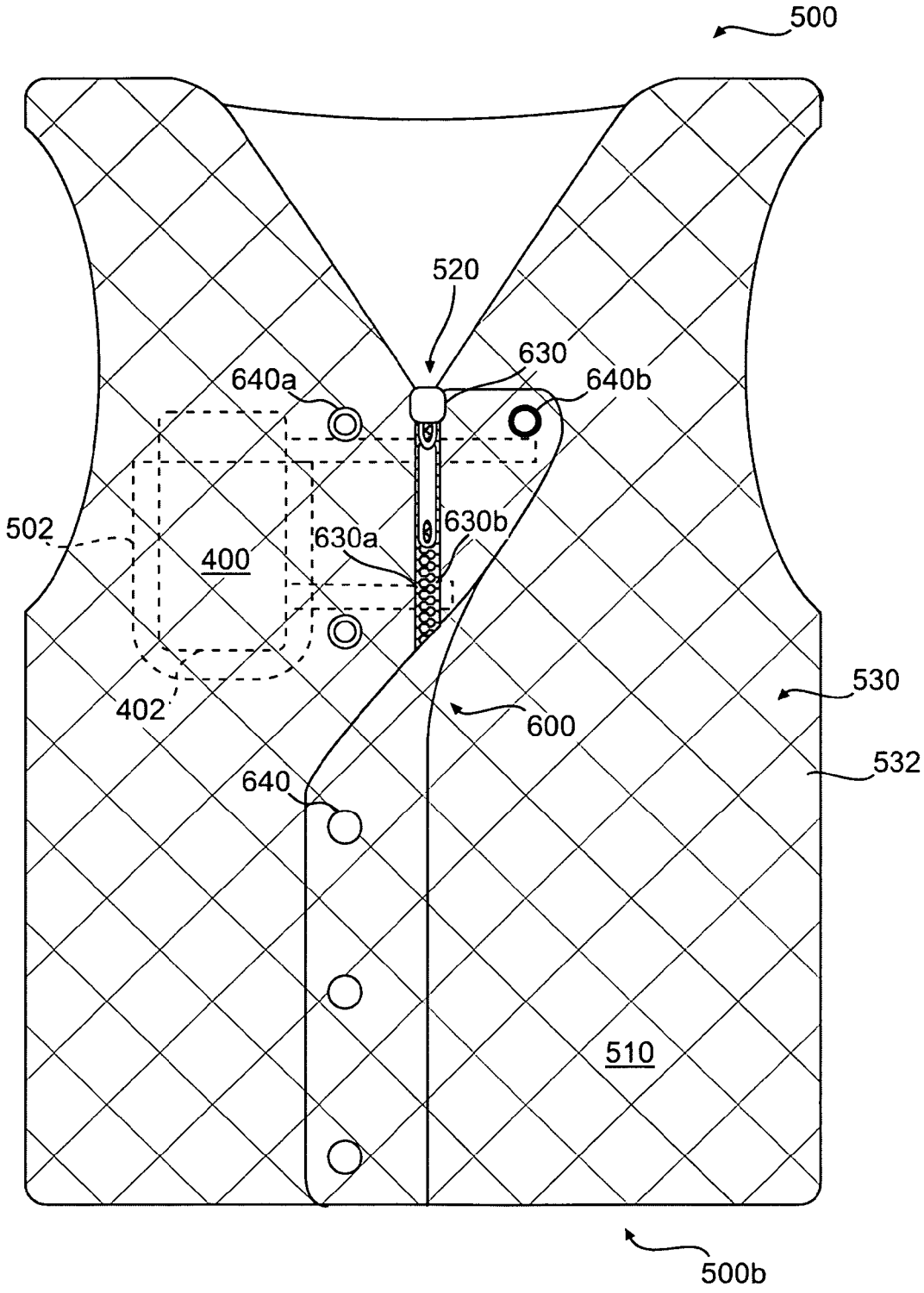
FIG. 3 shows a second exemplary embodiment of a personal security device consistent with the present invention.

Each personal security device 200 may include a personal safety module 400 (see FIG. 4) for monitoring the personal safety of users 10 and transmitting information regarding users' personal safety to monitoring network 300. In some embodiments, personal safety module 400 may be secured to or carried by a harness 500 configured to be worn by a user 10. As illustrated in FIGS. 2 and 3A, harness 500 may be configured to be worn about a user's thorax. For example, harness 500 may be configured, e.g., as a chest harness 500A (as shown in FIG. 2) or as a vest 500B (as shown in FIG. 3). Such a harness may be more difficult for, e.g., a kidnapper to remove than a bracelet or collar. However, harness 500 is not limited to the illustrated embodiments, and other suitable configurations of harness 500 will be apparent to those of skill in the art.

For example, harness 500 may also be configured to resemble another type of garment, such as a shirt or a jacket. Further, harness 500 may be configured to be worn about another portion of a user's body. For example, harness 500 may be configured similar to a pair of pants or shorts, so as to be worn about a user's waist.

In some embodiments, harness 500 may be configured so as to resemble a conventional garment. For example, harness 500 may be configured to resemble an undergarment (e.g., a brassiere), etc. Alternatively, harness 500 may be configured to resemble a conventional belt, or a strap for a wrist watch. In the latter case, personal safety module 400 may be placed within a casing resembling a conventional watch casing and additionally perform one or more functions of a conventional watch. In addition, personal security module 400 may be adapted to be concealed in a user's own clothing. Thus, the true function of personal security device 200 may be concealed from, e.g., a kidnapper.

It is to be understood that harness 500 is not limited to the embodiments mentioned herein or illustrated in the FIGS. 2 and 3. Other suitable configurations of harness 500 will be apparent to those of skill in the art.

As shown in FIGS. 2 and 3, harness 500 may include a body portion 510 and a fitting portion 520. Body portion 510 may be configured to carry personal safety module 400. Fitting portion 520 may be configured to allow body portion 510 to be fit closely about the wearer's person. Fitting portion 520 may have an open (or loose) position (see FIG. 2), configured to allow the user 10 to don harness 500 and to take it off, and a closed (or tight) position (see FIG. 3), configured to securely fit harness 500 about the wearer's person.

Fitting portion 520 may be provided with a closure 600 configured to secure fitting portion 520 in the closed (or tight) position. Body portion 510 and closure 600 may be configured so that harness 500 may not be removed from the user's person without operating (e.g., loosening and/or unfastening) closure 600.

In exemplary chest harness 500A (FIG. 2), for example, body portion 510 may be formed by one or more straps 512. It is to be understood that, in the embodiment of FIG. 2, straps 512 are continuous across the back of the user 10. Straps 512 may be made using, e.g., seat-belt type webbing or other material that is difficult to cut. As shown in FIG. 2, fitting portion 520 may be formed by an opening between complementary ends 512*a, b* of straps 512. Alternatively, fitting portion 520 may be implemented by providing a mechanism (not shown) allowing the length of straps 512 to be adjusted to a girth sufficient to allow harness 500 to be removed from the user's person.

As illustrated in FIG. 2, closure 600 may be implemented using a brace 610 similar to the brace disclosed in my co-pending U.S. patent application Ser. No. 10/986,864, filed Nov. 15, 2004, and entitled "SYSTEMS AND APPARATUS FOR SECURE SHIPPING," which is incorporated herein by reference in its entirety. Brace 610 may be manufactured using any of a variety of materials which present a physical barrier to tampering. For example, brace 610 may be manufactured using case-hardened steel. Brace 610 may be formed as a circular cylinder, as shown in FIG. 2. However, brace 610 may be any of a variety of other shapes, without departing from the scope of the present invention.

Brace 610 may be configured to operably engage fitting portion 520 so as to secure fitting portion 520 in the closed (or tight) position. As shown in FIG. 2, fitting portion 520 may be provided with corresponding first and second cross-pieces 522*a* and 522*b*, respectively, e.g., on respective ends 512*a, b* of straps 512. Cross-pieces 522*a* and 522*b* may each include a plurality of parallel knobs 524 alternately spaced along their lengths. Brace 610 may include a corresponding plurality of parallel tracks 612 configured to engage knobs 524.

Each track 612 may include an open end 612*a* configured to allow knob 524 to be inserted into or removed from track 612, and a closed end 612*b* configured to prevent knob 524 from being removed from track 612. Each track 612 may further include first and second bends 612*c* and 612*d*, respectively, so that tracks 612 each form a "U" shape. However, tracks 612 may be configured in different shapes, e.g., with more or fewer bends, or no bends, consistent with the present invention.

To secure harness 500 about their person, a user 10 may align cross-pieces 522*a* and 522*b* as shown in FIG. 2 and engage open ends 612*a* of respective tracks 612 with corresponding knobs 524 so that knobs 524 may enter respective tracks 612. The user 10 may then rotate brace 610 so as to slide knobs 524 in parallel to first bends 612*c* of respective tracks 612, slide brace 610 so as to slide knobs 524 in parallel to second bends 612*d* of respective tracks 612, and, finally, rotate brace 610 in the opposite direction so as to slide knobs 524 in parallel to closed ends 612*b* of respective tracks 612.

For ease of manufacture, brace 610 may be formed of a plurality of substantially identical track units 614 connected together in series. Each track unit 614 may include one track 612. In this manner, brace 610 may be manufactured in different sizes by varying the number of track units 614 in brace 610.

In some embodiments, brace 610 may include a locking mechanism 620. Locking mechanism 620 may be operative to lock brace 610 in the closed position on harness 500. For example, locking mechanism 620 may include a mechanical locking mechanism configured to lock brace 610 in the closed position when knobs 624 are moved to the closed ends 612*b* of tracks 612.

Locking mechanism 620 may be controlled, i.e., locked and unlocked, by a lock controller 624. Lock controller 624 may include any of a variety of known lock control mechanisms. For example, lock controller 624 may be implemented using a mechanical key mechanism, a magnetic key mechanism, an electronic key mechanism, a password mechanism, a combination lock mechanism, etc.

In one embodiment, lock controller 624 may include a biometric key mechanism. For example, lock controller 624 may be configured to lock or unlock locking mechanism 610 only upon scanning, e.g., a fingerprint, an iris, etc., of an authorized person.

For instance, lock controller 624 may include a scanner (not shown) operative to scan a user's fingerprint. The scanner may include appropriate electronics and/or software configured to determine whether a scanned fingerprint matches an authorized fingerprint stored in a memory (see memory 415, discussed below). Lock controller 624 may also include a mechanism, e.g., a servomechanism, configured to release locking mechanism 620 if the scanner indicates that a scanned fingerprint matches an authorized fingerprint. For example, lock controller 624 may include a servomechanism (not shown) for moving locking mechanism 620 from a locked to an unlocked position.

In order to prevent the user 10 from being forced to unlock locking mechanism 620, e.g., by a kidnapper, the user 10 may not be given a key to the lock controller 624 for the personal security device they are to wear. For example, where lock controller 624 includes a fingerprint scanner, the wearer's fingerprint may not be included among the authorized fingerprints.

In one embodiment, locking mechanism 620 may include a lock bar (not shown) within brace 610 that is configured to simultaneously engage knobs 524 so as to lock knobs 524 in place at the closed ends 612*b* of respective tracks 612. The lock bar may be actuated mechanically, e.g., by the movement of knobs 524 to the closed ends 612*b* of tracks 612, or by the movement of a key, etc. in locking mechanism 620.

In the exemplary vest 500B of FIG. 3, body portion 510 may be fashioned using, e.g., conventional clothing materials. Alternatively, body portion 510 may be fashioned using a ballistic material, such as Kevlar, so that vest 500B may provide additional protection to the user 10. Fitting portion 520 may be formed by an opening between complementary sides of vest 500B. Alternatively, fitting portion 520 may be implemented by providing a mechanism (not shown) allowing the girth of vest 500B to be adjusted.

Closure 600 may be implemented using any of a variety of closures known in the art, such as straps, clips, buckles, buttons, snap buttons, hooks, zippers, hook and loop fastener (e.g., Velcro), etc. As shown in FIG. 3, for example, closure 600 may include a zipper 630 and/or snap buttons 640. In addition, vest 500B may include other features similar to conventional vests, such as pockets (not shown). In this embodiment, closure 600 does not include a lock, so as not to appear different than a conventional item of clothing.

Personal safety module 400 may be secured to harness 500. For example, personal safety module 400 may be placed within a housing or housings 402 that may be secured to body portion 510, e.g., with a rivet (not shown) or other fastener known in the art. Housing 402 may be reinforced in order to deter and prevent unauthorized access to module 400. As illustrated in FIG. 2, for instance, personal safety module 400 may be located within brace 610. In this manner, the structure of brace 610 may function as housing 402.

Alternatively, personal safety module 400 may be carried by harness 500. As illustrated in FIG. 3, for instance, personal safety module 400 may be carried within an interior pocket 502 of vest 500B.

It is to be understood that the location of personal safety module 400 on harness 500 is not limited to those illustrated in FIGS. 2 and 3. One of skill in the art will recognize that personal safety module 400, or one or more of its components, may be located elsewhere on the user's person, consistent with the present invention.

Figure 4:
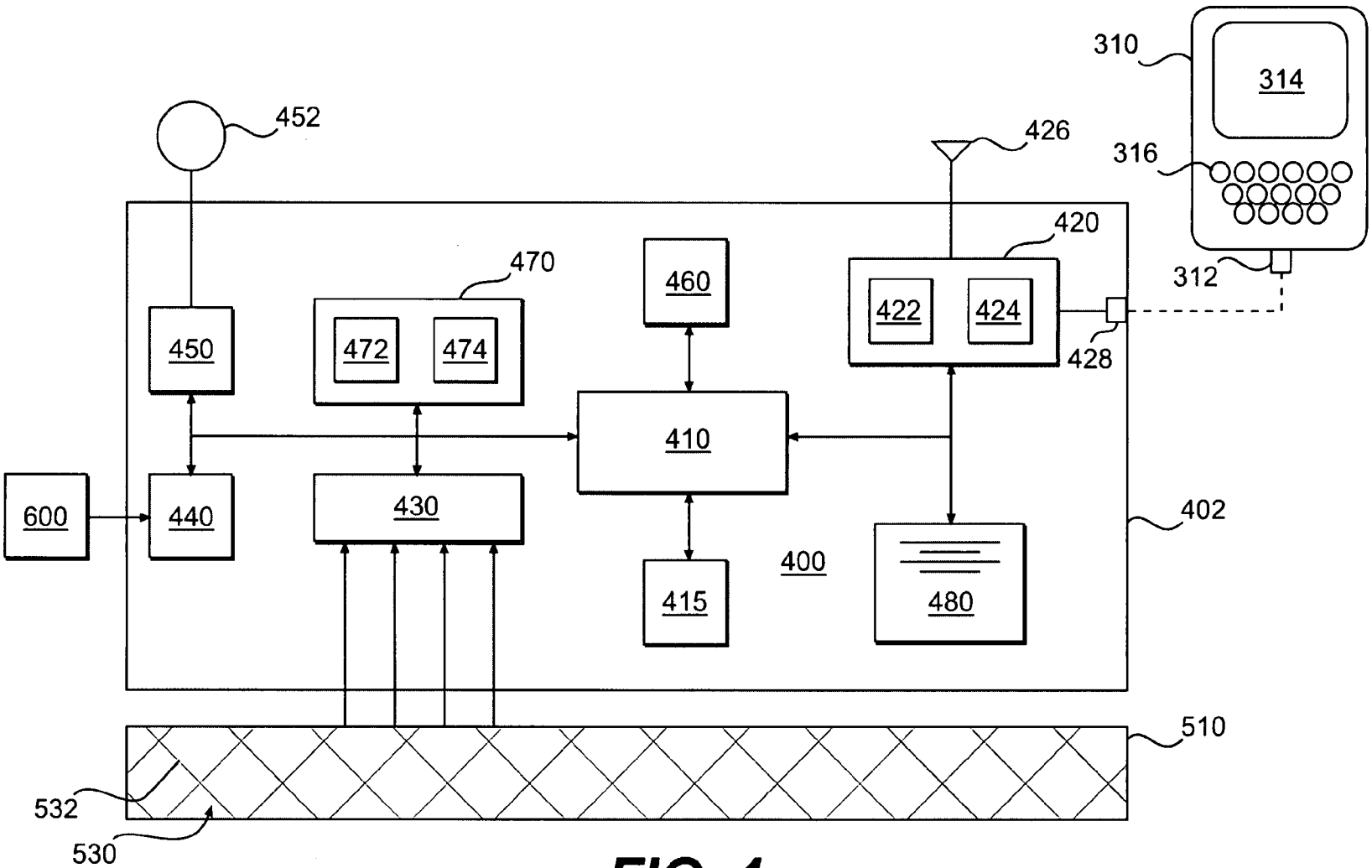
FIG. 4 schematically illustrates a personal safety module, consistent with the present invention.

The operation of personal safety module 400 will now be explained, with reference to FIG. 4. As illustrated in FIG. 4, personal safety module 400 may include a manager 410, a memory 415, a network interface 420, a harness sensor 430, a closure sensor 440, a biometric sensor 450, a position sensor 460, a user interface 470, and a power source 480.

Manager 410 may manage the operation of sensors 430, 440, 450 and 460 and interfaces 420 and 470. For example, manager 410 may be adapted to detect a breach of the user's personal safety via sensors 430, 440 and 450. Manager 410 may also be adapted to determine the position of personal security device 200 via position sensor 460 using, e.g., Global Positioning System (GPS) technology. Manager 410 may further be adapted to communicate with the user 10 via user interface 470. In addition, manager 410 may be adapted to communicate with monitoring network 300 via network interface 420.

Manager 410 may be implemented using, e.g., a general purpose computer having a processor that may be selectively activated or configured by a computer program to perform one or more methods consistent with the present invention. Alternatively, manager 410 may be implemented using a specially constructed computer or other electronic circuit.

Memory 415 may store computer programs and/or data used to configure manager 410. Memory 415 may also store identifying information for personal security device 200. For example, memory 415 may store a serial number or other identifier for personal security device 200. Memory 415 may also store, for example, information identifying the user 10 of device 200 (e.g., by name, etc.) and/or other identifier. Information may be transferred into memory 415 through network interface 420 or user interfaces 470. Memory 415 may be implemented using, e.g., RAM and/or ROM memory.

Network interface 420 may be provided to allow communication between personal safety module 400 and monitoring network 300. Network interface 420 may include a transmitter 422. Network interface 420 may also include a receiver 424. Transmitter 422 and/or receiver 424 may be linked to monitoring network via a wireless interface, e.g., an RF interface 426, and/or a wired interface 428. Manager 410 may use network interface 420 to report a breach of integrity to monitoring network 300. For example, if manager 410 detects a breach of integrity via any one of sensors 430, 440 and 450, then manager 410 may transmit a breach signal to monitoring network 300 via wireless interface 426. The breach signal may identify the particular personal security device 200 (e.g., by an identifier contained in memory 415) and provide an indication that the personal safety of the user 10 has been breached.

Network interface 420 may also be used to access memory 415. For example, a manufacturer or service technician may use network interface 420 to load a new program for manager 410 into memory 415. Also, the user 10 of security device 100 may use network interface 420 to load information, such as information related to, e.g., the identity of the user 10 or medical conditions of the user 10, into memory 415. As another example, the owner of personal security device 200, e.g., the user's employer, may use network interface 420 to enter information, such as the identity of the owner, into memory 415. Further, network interface 420 may be used by government authorities or medical personnel to download information, e.g., regarding a medical condition of the user 10, or contact information for the user's employer or family, in the case that the wearer has become incapacitated.

Communications with network interface 420 may be password-protected and/or encrypted to prevent unauthorized persons from gaining control of manager 410 or accessing information in memory 415. Further, different entities may be given different passwords that allow different levels of access to manager 410 and/or memory 415. For example, medical personnel may be given a password that allows them to access medical information stored in memory 415, but rot to reprogram manager 410 or to change information identifying the owner of personal security device 200.

Sensors 430, 440 and/or 450 may be provided to sense a breach of the user's personal safety. For example, sensors 430, 440 and/or 450 may sense removal of personal security device 200 from the user's person. In one embodiment, sensors 430, 440 and 450 may sense at least the removal of transmitter 422 from the user's person. In this manner, personal security device 200 may ensure that the user is co-located with the signal from transmitter 422.

Harness sensor (or sensors) 430 may be provided to detect a breach of integrity of harness 500. In some embodiments, harness sensor 430 may be operable to sense that body portion 510 of harness 500 has been mutilated, e.g., cut or torn. As shown in FIG. 2–4, for example, harness sensor 430 may be operatively linked to an integrity matrix 530 provided on body portion 510 of harness 500. Matrix 530 may be formed by a plurality of conductive lines 532. Alternatively, a single conductive line 532 may be provided.

Matrix 530 may be embedded within body portion 510. As illustrated in FIG. 2, for instance, matrix 530 may be embedded within straps 512 so that a conductive line 532 must necessarily be severed in order to cut through any portion of strap 512. In the embodiment of FIG. 3, conductive lines 532 may be embedded within the material of body portion 510 of vest 500B. Where body portion 510 comprises a woven material, matrix 530 may be woven within the material of body portion 510. Alternatively, matrix 530 may be located on an inner or outer surface of body portion 510, or between layers of material of body portion 510.

Matrix 530 may extend across areas of body portion that could be cut, e.g., by a kidnapper, in order to remove transmitter 422 and/or other components of personal safety module 400 from the user's person. For example, matrix 530 may be coextensive with body portion 510. Alternatively, matrix 530 may be provided only in discrete sections of body portion 510.

Harness sensor 430 may interface with matrix 530 in a variety of ways. In the embodiment of FIG. 2, for example, the ends of lines 532 may be placed within knobs 524 of fitting portion 520. Harness sensor 430 may be positioned to operatively engage knobs 524, and thus the ends of lines 532, when brace 610 is placed in the locked position. For instance, one end of each line 532 may be placed in a first one of knobs 524 on first cross-piece 522*a,* and an opposite end of each line 532 placed in a second one of knobs 532 on second cross-piece 522*b.*

Harness sensor 430 may be configured to detect a cut or break in a conductive line 532 of matrix 530. For example, harness sensor 430 may be configured to sense a lack of continuity between the ends of lines 532. If harness sensor 430 reports a cut or break in a conductive line 532 of matrix 530 to manager 410, then manager 410 may indicate a breach of integrity.

In one embodiment consistent with the present invention, a line 532 may comprise a light conducting fiber, such as a fiber optic line. Harness sensor 430 may then be configured to, e.g., input light at one end of line 532 and detect a break or cut in line 532 by sensing that the light is attenuated or not received at the other end of line 532, or that the light is reflected back to the one end of line 532.

In another embodiment consistent with the present invention, line 532 may comprise an electrically conducting wire or wires. Harness sensor 430 may then be configured to detect a break or cut in line 532 by sensing an open circuit between the ends of line 532. For instance, harness sensor 430 may be configured to place a small voltage across each line 532 and to detect an open circuit by sensing, e.g., high impedance between the ends of line 532. In addition, the presence of electrically conducting wires within body portion 510 may make it more difficult to cut through body portion 510, and thus provide a physical deterrent to forced removal of harness 500 from the user's person.

Closure sensor 440 may be adapted to sense whether closure 600 is in an open (loose) or closed (tight) state, and to indicate the state of closure 600 to manager 410. With respect to the embodiment of FIG. 2, for example, closure sensor 440 may be configured to sense whether locking mechanism 620 is in a locked state or an unlocked state.

For example, closure sensor 440 may include a sensor, such as a detent or other position sensor (not shown), adapted to determine whether locking mechanism 620 is in an unlocked state. If closure sensor 440 indicates that locking mechanism 620 is in an unlocked state, then manager 410 may determine whether the unlocked state has been authorized. For instance, manager 410 may determine whether locking mechanism 620 was opened in an authorized manner, e.g., by the scanning of an authorized fingerprint. If locking mechanism 620 is in an unlocked state that has not been authorized (e.g., if locking mechanism 620 has been forced open), then manager 410 may indicate a breach of integrity.

With respect to the embodiment of FIG. 3, closure sensor 440 may be configured to sense whether complementary portions of closure 600 are in the closed position. As shown in FIG. 3, for example, closure sensor may be operatively linked to complementary teeth 630*a, b* of zipper 630, e.g., by a conductive line, such as an electrically conductive wire or optical fiber. Closure sensor 440 may sense whether zipper 630 is in the closed (zipped) or open (unzipped) position, e.g., using a detent or other position sensor, or by sensing whether teeth 630*a, b* complete an electrical, magnetic or optical circuit. Closure sensor 440 may similarly sense whether complementary portions 640*a, b* of snap buttons 640 are in the closed (buttoned) position or open (unbuttoned) position, e.g., using a detent or other position sensor, or by sensing whether complementary portions 640*a, b* complete an electrical, magnetic or optical circuit.

If closure sensor 440 indicates that the closure is in an open state, then manager 410 may determine whether the open state has been authorized. For example, manager 410 may contain instructions indicating that, in order to be authorized, the opening of closure 600 must take place in a certain manner. With respect to the embodiment of FIG. 3, for example, the opening of closure may be considered to be unauthorized unless zipper 630 is opened at a particular speed, e.g., as measured between the breaking of a circuit between complementary teeth 630*a, b* at different positions on zipper 630. Further, the opening of closure may be considered to be unauthorized unless snap buttons 640 are opened in a particular order.

Thus, if a user 10 is forced to remove personal security device 200 under duress, the user 10 may clandestinely indicate this fact by failing to follow the authorized removal procedures. If closure 600 is opened in an unauthorized manner, then manager 410 may indicate a breach of integrity.

Biometric sensor 450 may be configured to detect the removal of harness 400 from the user's person by detecting the absence of a biometric signal from user 10. In one embodiment, biometric sensor 450 may configured to sense a bio-potential of the user 10. For example, biometric sensor 450 may include an electrode 452 configured to be placed on a designated area of the user's body. Alternatively, biometric sensor 450 may be configured to sense a user's pulse, heartbeat, body temperature, or other suitable biometric activity.

If biometric sensor 450 indicates an absence of the expected biometric activity, then manager 410 may determine whether removal of biometric sensor 450 from the user's person has been authorized. For example, manager 410 may contain instructions indicating that, in order to be authorized, the removal of biometric sensor 450 must take place within a certain window of time before or, alternatively, after the opening of closure 600. Thus, if personal security device 200 is forcibly removed from the user's person, e.g., by a kidnapper, the authorized procedure for removal of biometric sensor 450 will likely not be followed. If biometric sensor 450 is removed in an unauthorized manner, then manager 410 may indicate a breach of integrity. In addition, if biometric sensor 450 indicates that the value of the biometric signal lies outside of a specified normal range (e.g., if the biometric signal is indicative of heart failure), manager 410 may transmit a signal indicating that the user's health is in danger.

Position sensor 460 may sense the position of personal security device 200. For example, position sensor 460 may detect position signals, e.g., from the Global Positioning System (GPS). Position sensor 460 may periodically provide positional information to manager 410. Manager 410 may periodically transmit an indication of the position of personal security device 200 to monitoring network 300.

User interface 470 may be provided to provide information to the user 10, and/or to receive commands from the user 10. In one embodiment, user interface 470 may include one or more output devices 472 for providing information to the user 10, and/or one or more input devices 474 for receiving input and/or commands from a user 10.

Exemplary output devices 472 may include audio, visual and/or tactile output devices. For instance, output devices 472 may include one or more lights, displays (e.g., a liquid crystal display), speakers, and/or tactile indicators, such as a vibrating indicator.

Manager 410 may use output devices 472 to provide information regarding the status of the components 410–480 of personal safety module 400. For example, manager 410 may output devices 472 to provide an indication of a fault condition, such as blinking light to indicate a low-battery condition, or other fault.

As another example, if sensors 430, 440 and/or 450 indicate a breach of integrity of personal security device 200, manager 410 may control one or more of output devices 472 to provide the wearer with an indication of the breach. For instance, manager 410 may control a speaker to sound an alarm if a breach of integrity has been indicated. In this manner, personal security device 200 may warn would-be kidnappers that the user 10 is protected by personal security device 200, thus deterring further threats to the user's personal safety.

However, in one embodiment, only a tactile indicator (e.g., on an interior surface of harness 500) is used to indicate a breach of integrity to the user 10. In this manner, manager 410 may alert the user 10 that a breach has been indicated (e.g., to assure the user 10 that help has been summoned, or, alternatively, in the case of an inadvertent breach by the user 10, so that the user 10 can cancel the breach signal) without alerting, e.g., a kidnapper that the wearer is protected by personal security device 200. Alternatively, a breach of integrity may be indicated only to the monitoring network, and not to the user, in order to conceal the indication from, e.g., a kidnapper.

Further as illustrated in FIG. 4, input devices 474 may include one or more buttons, switches, keys, etc., and/or a voice input device (such as a microphone) which a user 10 may use to communicate with manager 410 and/or monitoring network. In one embodiment, input devices 474 may include an input for actuating an alarm. For example, input devices 474 may include a panic button, which the user 10 may press in order to indicate that they are in need of assistance. If the user 10 presses the panic button, then manager 410 may indicate a breach. In order to prevent inadvertent actuation of panic button, manager 410 may require, for example, that the panic button be pressed in a prescribed manner (e.g., that it be pressed twice within a specified period of time), or that other procedures be followed. If the panic button is pressed in a manner other than prescribed, then manager 410 may decline to indicate a breach. The panic button may be concealed, e.g., in a pocket of vest 500B.

Input devices 474 may also include an input for canceling a breach signal. For example, input devices 474 may include a cancel button, which the user 10 may press in order to cancel a breach signal that the user 10 may have caused inadvertently. If the user 10 presses the cancel button, then manager 410 may cancel a breach signal. In order to prevent, e.g., a kidnapper from canceling a breach signal, manager 410 may require, for example, that the cancel button be pressed in a prescribed manner (e.g., using a pattern similar to Morse code), or that other procedures be followed. If the cancel button is pressed in a manner other than prescribed, then manager 410 may refuse to cancel the breach signal.

Input devices 474 may also include a keypad and/or a microphone, which the user 10 may use to communicate with the monitoring entity via network interface 420. For example, if the user 10 wishes to travel outside of their authorized area, the user 10 may communicate with the monitoring entity using one or more of input devices 474 in order to request that their authorized area be extended (as discussed below).

Together, output devices 472 and input devices 474 may allow two-way communication between users 10 and hub 330. In addition, user interface 470 may allow communication between users 10 and other entities. For example, user interface may function as a cellular telephone for communication with hub 330 or other entities.

Power source 480 may be provided to supply electrical power to components 410–470. Power source 480 may include, e.g., a battery, such as a rechargeable lithium or NiCad battery.

Monitoring network 300 may be configured to monitor personal security devices 200 under the control of the monitoring entity. Monitoring network 300 may also be adapted to locate and/or track the location of personal security devices 200 as users travel within the area covered by monitoring network 300. Monitoring network 300 may also be adapted to detect travel of a particular personal security device 200 outside of an authorized area for that device. In addition, monitoring network 300 may be adapted to monitor secure containers as disclosed in my co-pending U.S. patent application Ser. No. 10/986,864, filed Nov. 15, 2004, and entitled "SYSTEMS AND APPARATUS FOR SECURE SHIPPING," which is incorporated herein by reference in its entirety.

Authenticator 310 (FIGS. 1 and 4) may be provided to communicate with managers 410 of personal safety modules 400. Authenticator 310 may be implemented using any appropriate general purpose or specially constructed computer that may be programmable to carry out methods consistent with the present invention. For example, authenticator 310 may be implemented using a personal computer, network computer, etc. In one embodiment, authenticator 310 may be implemented using a handheld personal digital assistant PDA). As shown in FIG. 4, authenticator 310 may include a device interface 312 that is compatible with network interface 420 of personal safety module 400, a display 314, and a data entry device (e.g., a keyboard, keypad, voice input, mouse, etc.) 316.

Authenticator 310 may be used to access memory 415 of secured device 100 via network interface 420. For example, authenticator 710 may be used by users, owners, government authorities or medical personnel to access information in memory 415 and/or to give commands to manager 410. For instance, a service technician may use an authenticator 310 to reprogram manager 410. As another example, medical personnel may use an authenticator 310 to determine whether the user 10 of a particular personal security device has a medical condition, or to determine who to contact regarding the user's medical care. Once accessed using the proper password and/or decryption, the information from memory 415 may be displayed on display 314 and/or changed using data entry device 316.

Monitors 320 may monitor the safety of users 10 by communicating with personal security devices 200. Monitors 320 may include a wireless interface 322 compatible with network interface 420 of personal security devices 200. Monitors 320 may send signals to and receive signals from security devices 100 via wireless interface 322 (as described below).

Monitors 320 may be placed so as to provide continuous monitoring of personal security devices 200 throughout an authorized area of travel of users 10. For example, monitors 320 may be placed in areas that the users of personal security devices 200 may traverse during the normal course of their work and/or personal lives. For instance, monitors 320 may be placed to cover the areas where the wearer works, as well as the route or routes they may take to or from work. Monitors 320 may be land-based and/or space based. In one embodiment, monitors may be implemented using cellular telephone substations.

In some embodiments, a mobile monitor 320*a* (FIG. 1) may be placed on a vehicle (e.g., an automobile, a plane, a ship, etc.) 20, so that the area inside or near the vehicle 20 may function as an authorized area. Mobile monitor 320*a* may also be configured to communicate with monitors 320 in the same manner as personal safety module 600. Monitoring network 300 may then be used to track the movement of vehicles inside their authorized area in the same manner as personal security devices 200.

Network hub 330 may be provided to control monitors 320. Hub 330 may comprise a general purpose computer (e.g., a personal computer, network computer, server, etc.) having a processor that may be selectively activated or configured by a computer program to perform one or more methods consistent with the present invention. Hub 330 may be implemented on a single platform, such as a stand-alone computer. Alternatively, hub 330 be implemented on a distributed network, such as a network of computers connected, e.g., by a LAN, WAN, etc. As shown in FIG. 1, hub 330 may be linked to monitors 320 via wired or wireless interfaces 332. Communications between hub 330 and monitors 320 may be encrypted to prevent unauthorized persons from gaining control of monitors 320.

Monitoring network 300 may be used to monitor the integrity of personal security devices 200. As set forth above, if manager 410 of a particular personal security device 200 detects a breach of integrity, then manager 410 may report the breach to monitoring network 300 by transmitting a breach signal identifying the particular security device 200.

When a particular monitor, e.g., mobile monitor 320*a*, receives a breach signal from a particular personal security device 200*a*, the particular monitor 320*a* may then notify hub 330 that the integrity of the particular security device 200 has been breached. Hub 330 may then report that personal security device 200*a* has been breached in the area covered by monitor 320*a* and request that the breach be investigated. For example, hub 330 may send an automated electronic message to law enforcement or security personnel indicating that the personal safety of the particular user 10*a* is in danger and requesting an investigation.

Monitoring network 300 may also be used to locate and/or track the location of personal security devices 200 monitored by security system 300. For example, an access terminal 340 may be provided to facilitate requests for the location and/or tracking of personal security devices 200 monitored by security system 300.

Access terminal 340 may be linked to hub 330 through a network 350, e.g., an intranet or the Internet. Access terminal 340 may be given access to hub through an appropriate middleware program residing on hub 330 or network 350. Access to hub 330 from access terminals 340 may be password protected and/or encrypted to prevent unauthorized use of monitoring network 300. Further, different entities may be given different passwords that allow different levels of access to monitoring network 300.

For example, the family of a particular user 10*a* may be allowed to access location or tracking information for the particular personal security device 200*a* assigned to the particular user 10*a* and no other, while an employer may be allowed to access location or tracking information for those personal security devices 200 that are worn by its employees and no other. By contrast, government authorities may be allowed to request location or tracking of any personal security device 200 monitored by security system 100.

When hub 330 receives an authorized request for the location or tracking of a the personal security device 200*a* worn by a particular user 10*a*, hub 330 may control monitors 320 to locate or track the particular personal security device 200*a*. For example, hub 330 may begin by activating a particular monitor 320*b*, covering the area where the particular security device 200*a* is considered most likely to be found, e.g., the area in which the wearer of the particular security device 200*a* is expected to be at that time. For instance, hub 330 may begin by activating a particular monitor 320*b* covering the area closest to the position indicated in the last position indication transmitted by personal safety device 200.

When activated, monitor 320*b* may transmit a locator signal via wireless interface 322. The locator signal may contain the identifier which specifies the particular personal security device 200*a* to be located. The locator signal may then be received by the wireless interface 426 of each security device 200 in the broadcast area of monitor 320*a*.

The manager 410 of each personal security device 200 that receives the locator signal may then determine if the identifier included in the locator signal matches the identifier in memory 415. If the two identifiers do not match, then manager 410 may ignore the locator signal. However, if the two identifiers do match, then manager 410 may transmit a corresponding response signal identifying personal security device 200*a* and or its user 10 to monitor 320*b*.

When monitor 320*b* receives the response signal, monitor 320*b* may notify hub 330 that the particular personal security device 200*a* has been found in the broadcast area of monitor 320*b*. Where to or more monitors 320 receive the response signal, hub 330 may triangulate the position of the particular personal security device 200*a*. Alternatively, hub 330 may receive a position indication from the particular personal security device 200. Hub 330 may then report the location of the particular personal security device 200 to the access terminal 340 that requested the information. If tracking of the personal security device 200 was requested, then hub 330 may periodically reinitiate the location process and provide updated location information to the requesting access terminal 340.

If the particular personal security device 200 is not found in the first area searched, hub 330 may proceed by activating the monitor 320*c* covering the area where the particular personal security device 200*a* is considered next most likely to be found, and so on, until the particular security device 200 is found or all of the monitors 320 in monitoring system 300 have been activated without locating the particular security device 200. In the latter case, hub 330 may report to the requesting access terminal 340 that the particular personal security device 200 has not been found within the area covered by monitoring system 300. Hub 330 may then either initiate another round of locator signals or request a physical search for the particular user 10*a*. For example, hub 330 may send an automated electronic message to law enforcement personnel indicating the need for a search.

In addition, monitoring network 300 may communicate with a particular user or users via user interface 470 (FIG. 4) of personal safety module 400. For example, monitoring network 300 may send broadcast messages, e.g., warnings or alerts, to users 10 via output devices 472. Further, monitoring network may provide for one or two-way communications with a particular user via user interface 470.

For example, if the user 10 wishes to travel outside of their authorized area, the user 10 may communicate with the monitoring entity using one or more of input devices 474 in order to notify the monitoring entity that they intend to do so, or to request that their authorized area be extended. In one embodiment, the monitoring entity may process such requests using a human operator. In another embodiment, the monitoring entity may process such requests automatically, e.g., using a touch-tone menu that the user 10 may navigate using input devices 474, or a telephone, such as a cellular telephone.

For example, a particular user 10*a* may use input devices 474 to send a control signal to hub 330 (FIG. 1). The control signal may include commands, e.g., indicating that the user is leaving the authorized area and/or extending the authorized area to include the area the particular user 10*a* intends to travel into. Hub 330 may respond to the particular user 10*a* (e.g., via output devices 472) with a message indicating that the extension command has been received.

If a particular personal security device 200*a* leaves its authorized area, or leaves the area monitored by monitoring system altogether, without first receiving authorization (e.g., if the particular personal security device 200*a* fails to respond to a locator signal, responds to a locator signal outside of its authorized area, or transmits a position indication outside of its authorized area), then hub 330 may attempt to communicate with the particular user 10*a* via user interface 470 (FIG. 4). If such communication is unsuccessful, hub 330 may alert authorities that the particular user 10*a* has traveled outside of their authorized area and request a search for the particular user.

As set forth above, systems and apparatus consistent with the present invention deter and prevent threats, such as kidnapping, to the security of personnel. By detecting the forcible removal of personnel security device 200 from the user's person, systems and apparatus consistent with the present invention may prevent and deter kidnappings and other terrorist attacks. Accordingly, systems and apparatus consistent with the present invention may increase security of personnel, thereby allowing them to operate in areas, such as war zones, that would otherwise be unsafe.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A personal security device comprising:

a wireless transmitter operable to transmit information pertaining to a user to a monitoring network;

a harness for securing the transmitter to the user's person, wherein the harness is formed at least partially of a ballistic material;

a sensor for sensing removal of the transmitter from the user's person;

wherein the senor comprises a harness sensor operable to sense a breach of integrity of the harness; and a manager initiating transmission of a signal to the monitoring network when the sensor senses that the transmitter has been removed from the user's person.

2. A personal security device comprising:

a wireless transmitter operable to transmit information pertaining to a user to a monitoring network;

a harness for securing the transmitter to the user's person, wherein the harness comprises a closure for securing the harness about the user's persons;

a sensor for sensing removal of the transmitter from the user's person, wherein the sensor comprises a closure sensor operable to sense whether the closure is in a position allowing removal of the harness from the user's person; and a manager initiating transmission of a signal to the monitoring network when the sensor senses that the transmitter has been removed from the user's person.

3. The device of claim 2, wherein the closure sensor is operable to sense at least one of: whether a closure lock is in an unlocked state; whether complementary portions of the closure are in an open state; whether a button is in an unbuttoned state; and whether a zipper is in an unzipped state.

4. A personal security device comprising:

a wireless transmitter operable to transmit information pertaining to a user to a monitoring network;

a harness for securing the transmitter to the user's person;

a sensor for sensing removal of the transmitter from the user's person, wherein the sensor comprises a harness sensor operable to sense a breach of integrity of the harness; and a manager initiating transmission of a signal to the monitoring network when the sensor senses that the transmitter has been removed from the user's person.

5. The device of claim 4, further comprising a sensor for sensing removal of the transmitter from the user's person by detecting the absence of a bio-metric signal from the person.

6. The device of claim 5, wherein the biometric signal comprises at least one of a bio-potential, a pulse, a heartbeat, and body temperature.

7. The device of claim 4, further comprising at least one conductive line extending across at least a portion of the harness, the harness sensor sensing a breach of integrity of the harness by sensing an open circuit between the ends of the conductive line.

8. The device of claim 7, wherein the conductive line comprises at least one of an electrically conductive line, and a light conductive line.

9. The device of claim 4, further comprising a user input device, the user input device comprising an input for canceling the signal.

10. The device of claim 4, wherein the information comprises information related to a location of the user.

11. A personal security system comprising:

a monitoring network; and at least one personal security device, the device comprising:

a wireless transmitter operable to transmit information pertaining to a user to a monitoring network;

a harness for securing the transmitter to the user's person, wherein the harness is formed at least partially of a ballistic material;

a sensor for sensing removal of the transmitter from the user's person; wherein the senor comprises a harness sensor operable to sense a breach of integrity of the harness; and a manager initiating transmission of a signal to the monitoring network when the sensor senses that the transmitter has been removed from the user's person.

12. A personal security system comprising:

a monitoring network; and at least one personal security device, the device comprising:

a wireless transmitter operable to transmit information pertaining to a user to the monitoring network;

a harness for securing the transmitter to the user's person, wherein the harness comprises a closure for securing the harness about the user's person;

a sensor for sensing removal of the transmitter from the user's person, wherein the sensor comprises a closure sensor operable to sense whether the closure is in a position allowing removal of the harness from the user's person; and a manager initiating transmission of a signal to the monitoring network when the sensor senses that the transmitter has been removed from the user's person.

13. The system of claim 12, wherein the closure sensor is operable to sense at least one of: whether a closure lock is in an unlocked state; whether complementary portions of the closure are in an open state; whether a button is in an unbuttoned state; and whether a zipper is in an unzipped state.

14. A personal security system comprising:

a monitoring network; and at least one personal security device, the device comprising:

a wireless transmitter operable to transmit information pertaining to a user to the monitoring network;

a harness for securing the transmitter to the user's person;

a sensor for sensing removal of the transmitter from the user's person; and a manager initiating transmission of a signal to the monitoring network when the sensor senses that the transmitter has been removed from the user's person, wherein the sensor comprises a harness sensor operable to sense a breach of integrity of the harness.

15. The system of claim 14, further comprising a sensor for sensing removal of the transmitter from the user's person by detecting the absence of a bio-metric signal from the person.

16. The system of claim 15, wherein the biometric signal comprises at least one of a bio-potential, a pulse, a heartbeat, and body temperature.

17. The system of claim 14, further comprising at least one conductive line extending across at least a portion of the harness, the harness sensor sensing a breach of integrity of the harness by sensing an open circuit between the ends of the conductive line.

18. The system of claim 17, wherein the conductive line comprises at least one of: an electrically conductive line, and a light conductive line.

19. A personal security system comprising:

a monitoring network; and at least one personal security device, the device comprising:

a wireless transmitter operable to transmit information pertaining to a user to a monitoring network;

a sensor for sensing removal of the transmitter from the user's person;

a manager initiating transmission of a signal to the monitoring network when the sensor senses that the transmitter has been removed from the user's person; and a user input device, the user input device comprising an input for canceling the signal.

20. The system of claim 14, wherein the information comprises information related to a location of the user.

21. The system of claim 14, wherein the monitoring network comprises at least one monitor placed on a vehicle, the monitor operable to receive the signal.

22. The system of claim 14, further comprising an authenticator for accessing data from the manager.

23. The device of claim 2, wherein the manager is configured to determine whether the position of the closure has been authorized, and initiate the transmission of the signal if the position of the closure has not been authorized.

24. The device of claim 2, wherein the closure comprises a lock for locking the closure in a closed position.

25. The system of claim 12, wherein the manager is configured to determine whether the position of the closure has been authorized, and initiate the transmission of the signal if the position of the closure has not been authorized.

26. The system of claim 12, wherein the closure comprises a lock for locking the closure in a closed position.

* * * * *